US009322196B2

(12) United States Patent
Garthe et al.

(10) Patent No.: US 9,322,196 B2
(45) Date of Patent: Apr. 26, 2016

(54) PADLOCK

(71) Applicant: ABUS August Bremicker Söhne KG, Wetter-Volmarstein (DE)

(72) Inventors: Bernhard Garthe, Gevelsberg (DE); Wai Kuen Fan, Kowloon (CN); Manuel Thomas, Schwelm (DE)

(73) Assignee: ABUS August Bremicker Söhne KG, Wetter-Volmarstein (DE)

( * ) Notice: Subject to any disclaimer, the term of this patent is extended or adjusted under 35 U.S.C. 154(b) by 0 days.

(21) Appl. No.: 14/257,078

(22) Filed: Apr. 21, 2014

(65) Prior Publication Data

US 2014/0311196 A1 Oct. 23, 2014

(30) Foreign Application Priority Data

Apr. 22, 2013 (DE) ..... 10 2013 207 268

(51) Int. Cl.
*E05B 67/24* (2006.01)
*E05B 67/22* (2006.01)

(52) U.S. Cl.
CPC ..... *E05B 67/24* (2013.01); *E05B 67/22* (2013.01); *Y10T 70/452* (2015.04)

(58) Field of Classification Search
CPC ..... E05B 67/00; E05B 67/06; E05B 67/063; E05B 2067/066; E05B 67/08; E05B 67/18; E05B 67/24; E05B 67/22; E05B 67/365; Y10T 70/452
USPC ..... 70/20, 31, 35, 36, 37, 38 R, 38 A, 38 B, 70/39, 40, 38 C, 49, 51
See application file for complete search history.

(56) References Cited

U.S. PATENT DOCUMENTS 220,637 A 10/1879 Mix
1,703,193 A * 2/1929 Jacobi ..... E05B 67/24 70/38 A (Continued)

FOREIGN PATENT DOCUMENTS

DE 102011009011 A1 7/2012
WO 2005/106168 A1 11/2005

(Continued)

OTHER PUBLICATIONS

Bryce, Douglas M.. (1997). Plastic Injection Molding, vol. II—Material Selection and Product Design Fundamentals. Society of Manufacturing Engineers (SME). Online version available at: http://app.knovel.com/hotlink/toc/id:kpPIMVIIM8/plastic-injection-molding/plastic-injection-molding.*

(Continued)

*Primary Examiner* — Christopher Boswell
*Assistant Examiner* — Amanda L Miller
(74) *Attorney, Agent, or Firm* — Dinsmore & Shohl LLP

(57) ABSTRACT

A padlock for securing a switch of an industrial plant comprises a lock body and a hoop which is displaceably held at the lock body, wherein the lock body has a lock housing composed of plastic, a lock cylinder having a rotatable cylinder core, and a rotatable latching member, wherein the cylinder core and the latching member are rotationally fixedly coupled to one another by means of a coupling element and wherein the latching member is rotatable from a release position into a latching position to lock the hoop at the lock body. The padlock is characterized in that the coupling element has at least one first bearing section, one second bearing section and therebetween a shaft section between the latching member and the lock cylinder, said shaft section connecting the first bearing section to the second bearing section and having a smaller diameter than the two bearing sections.

16 Claims, 8 Drawing Sheets

(56) References Cited

U.S. PATENT DOCUMENTS

| | | | | | |
|---|---|---|---|---|---|
| 2,374,669 | A * | 5/1945 | Dequick | 70/38 A | |
| 2,430,391 | A * | 11/1947 | Dequick | 70/368 | |
| 3,172,279 | A * | 3/1965 | Patriquin | E05B 67/24 | 70/38 A |
| 3,473,352 | A * | 10/1969 | Foote | E05B 67/24 | 70/38 B |
| 4,098,100 | A * | 7/1978 | Wah | 70/38 A | |
| 4,998,422 | A * | 3/1991 | Borgmann et al. | 70/38 A | |
| 5,755,121 | A * | 5/1998 | Crass | 70/52 | |
| 6,848,283 | B1 | 2/2005 | Lin | | |
| 7,278,283 | B2 | 10/2007 | Meckbach | | |
| 8,096,151 | B2 | 1/2012 | Cheevers et al. | | |
| 8,234,896 | B2 | 8/2012 | Uliano | | |
| 2003/0159479 | A1 | 8/2003 | Kajuch et al. | | |
| 2005/0235709 | A1 * | 10/2005 | Meckbach | E05B 15/16 | 70/38 A |
| 2012/0103035 | A1 | 5/2012 | Cheevers et al. | | |
| 2012/0186308 | A1 | 7/2012 | Garthe | | |
| 2013/0276487 | A1 * | 10/2013 | Burmesch et al. | 70/42 | |

FOREIGN PATENT DOCUMENTS

| | | | |
|---|---|---|---|
| WO | 2006130660 | A2 | 12/2006 |
| WO | 2012/097994 | A1 | 7/2012 |

OTHER PUBLICATIONS

Den Hartog, J. P.. (1952). Advanced Strength of Materials. Dover Publications. Online version available at: http://app.knovel.com/hotlink/toc/id:kpASM00022/advanced-strength-materials/advanced-strength-materials.*

Master Lock 411 Zenex Safty Padlocks dated Nov. 8, 2012 (4 pages) www.safetyseries.com.

Translation of German Search Report dated Feb. 20, 2014 relating to DE 10 2013 207 268.6.

* cited by examiner

PADLOCK

CROSS-REFERENCE TO RELATED APPLICATIONS

This application claims priority of German Patent Application DE 102013207268.6 filed on Apr. 22, 2013.

FIELD OF THE INVENTION

The invention relates to a padlock for securing a switch of an industrial plant. The padlock comprises for this purpose a lock body and a hoop which is displaceably held at the lock body, wherein the lock body has a lock housing composed of plastic, a lock cylinder having a rotatable cylinder core, and a rotatable latching member, wherein the cylinder core and the latching member are rotationally fixedly coupled to one another by means of a coupling element and wherein the latching member is rotatable from a release position into a latching position to lock the hoop at the lock body.

BACKGROUND OF THE INVENTION

A particular area of application of a padlock is in the field of occupational safety. There is the risk in relation with the servicing of industrial plants, for example of a production machine, that the industrial plant deactivated for the purpose of servicing work is activated again by accident while the servicing work is still continuing. A substantial danger for the service engineer can result from this. It is therefore customary that the service engineer moves a switch associated with the industrial plant to an OFF position for the duration of the servicing work and secures it in this position, i.e. the switch is directly blocked or access to the switch is blocked. The named switch is typically an energy supply switch, for example a main electrical switch of a control device or of an energy supply device of the industrial plant (e.g. power switchbox). Alternatively to this, the named switch can, for example, be a valve of a liquid line or of a gas line.

In order effectively to avoid an accidental activation of the industrial plant by another person, each service engineer hangs a padlock on the named switch or on a blocking device associated with the switch before starting his work and locks said padlock. The switch is hereby secured in its OFF position, i.e. the switch cannot be moved accidentally back into an ON position by another person. When the service engineer has ended his work, he unlocks the padlock again and releases it from the switch. Each service engineer usually has his own individual padlock (or a plurality of his own individual padlocks) associated with him. This procedure is also called a lockout. The padlock used is accordingly called a lockout lock.

So that a plurality of service engineers can block and release the switch again independently of one another, a plurality of receivers (e.g. eyelets) can be provided at the switch for hanging a plurality of lockout locks. If only a single receiver for a lockout lock is provided, a securing claw can be used which is hung into the respective eyelet of the switch or of the associated blocking device and which in turn has a plurality of hang-in eyelets for a respective padlock. Only when the last padlock has been removed from the securing claw can the securing claw be removed from the switch so that it can again be brought into the ON position.

It is known in connection with such a securing of a switch of an industrial plant to equip the lockout lock used with a housing of plastic, with a hoop being displaceably held at the lock housing and with a lock cylinder being arranged in the lock housing. The lock cylinder can selectively be brought from an open position into a latching position to latch the hoop to the lock housing after the hoop has, for example, been hung into an eyelet of the switch. By forming the lock housing from plastic, a particularly light padlock results which is of advantage in the use as a lockout lock since the service engineers occasionally carry a plurality of lockout locks simultaneously. A housing of plastic can also contribute to a desired electrical insulation. By the use of a plastic housing, there is furthermore a particularly simple possibility of color marking the padlock. The smaller stability of a plastic housing in comparison with a lock housing made of metal does not represent any serious disadvantage in a lockout lock since the padlock only serves the purpose of securing a switch against unintentional actuation, but not, for example, as theft protection.

It is furthermore known by prior use by the Safety Padlock No. 411 of the Masterlock® company to design the lock housing as elongate, i.e. to configure a length of the lock housing as substantially larger than a maximum width of the lock housing. It is thereby possible to apply wording in two languages, for example, to such an enlarged surface of the lock housing which warns against the removal of the lockout lock. For instance, a warning in English can be printed in the upper region of the lock housing and a corresponding warning in Spanish can be printed in the lower region of the lock housing, for example. Alternatively, a photo of the respective service engineer person can be applied to the lock housing so that it is immediately recognizable who has attached the lock. To be able to extend the lock housing of the padlock in this manner, a coupling element can be provided in the lock housing which connects the latching member and the cylinder core to one another in a rotationally fixed manner. The coupling element in this respect has to be configured the longer the length of the lock housing is.

In the Safety Padlock No. 411 known by prior use, the coupling element and the latching member are configured in one part as a zinc die-cast part, with the coupling element being made as a full cylinder. The coupling element is supported on reinforcement ribs of the lock housing, which is known, for example, from U.S. Pat. No. 5,755,121. The lock housing is formed from plastic and is in this respect composed of two halves.

Both a manufacture by an injection molding process and a welding of the halves of a lock housing suffer from large tolerances, which can have the result that the reinforcement ribs jam the coupling element or the coupling element is seated too loosely between the reinforcement ribs. Consequently, a high frictional force can be generated, whereby the padlocks are relatively stiff in operation. In addition, particularly with large lengths of the coupling element, a canting of the coupling element at the cylinder jacket surface can occur. In addition, a solid coupling element produced from metal greatly increases the weight of the padlock in a disadvantageous manner.

Alternatively, the cylindrical coupling element can be guided, for example, in a cylinder jacket surface, whereby a support of the coupling element along the total cylinder jacket surface results. Due to the large surfaces rubbing against one another, a high frictional force is generated which can likewise result in padlocks which are stiff in operation.

SUMMARY OF THE INVENTION

It is an object of the invention to provide a padlock having a coupling element which is characterized by a low weight and a smooth operation.

This object is satisfied by a padlock having the features of claim 1 and in particular in that the coupling element between the latching member and the lock cylinder has at least one first bearing section, one second bearing section and therebetween a shaft section which connects the first bearing section to the second bearing section and has a smaller diameter than the two bearing sections.

The bearing sections of the coupling element are thus made thicker in comparison with the shaft section, whereby a barbell shape of the coupling element can substantially result. Much less material for the coupling element is required in comparison with a fully cylindrical configuration of the coupling element, which results in a lower weight of the coupling element and thus of the padlock.

In addition, the shaft section of the coupling element advantageously does not contact a support surface of the lock housing which is, for example, cylindrical, for the coupling element. A spacing is therefore provided between the shaft section of the coupling element and an associated inner surface of the lock housing. Only the first and second bearing sections are in contact with the support surface. Due to the much smaller surface of the bearing sections in comparison with a full cylinder, the frictional force between the support surface and the coupling element is greatly reduced. An opening and closing of the padlock is consequently associated with a smaller force effort.

Advantageous embodiments of the invention are described in the description, in the dependent claims and in the drawings.

In accordance with a first advantageous embodiment, the first bearing section is arranged at a first end of the coupling element and the second bearing section is arranged at a second end of the coupling element. The coupling element can thus only contact support surfaces of the lock housing in end regions, whereby the coupling element is supported in a particularly stable angular position with respect to an axis of rotation. In addition, a good force-transmitting connection to the latching member and to the lock cylinder can result due to the end regions of the coupling element enlarged in diameter.

Alternatively, the bearing sections can also be spaced apart from the ends of the coupling element and/or more than two bearing sections having a respective shaft section therebetween can be provided. Only two bearing sections and one shaft section between them are preferably provided between the latching member and the lock cylinder.

In accordance with a further advantageous embodiment, the bearing sections of the coupling element have cylindrical support surfaces at their periphery. The coupling element can therefore be substantially rotationally symmetrical about an axis of rotation, with the axis of rotation coinciding with the axis of the cylindrical support surfaces and of the shaft section. In this embodiment, the coupling element can be axially displaceably supported in the lock housing, whereby the assembly of the padlock can be simplified in manufacture.

Alternatively to this, the bearing sections can, for example, have the form of a torus segment, i.e. the support surfaces have the shape of a circular section rotated about the axis of rotation of the coupling element. Other types of curves than a circular form are also possible so that the support surfaces can e.g. correspond to the jacket surface of a barrel shape.

The lock housing advantageously has a first counter-bearing section and a second counter-bearing section, with the first counter-bearing section forming a plain bearing seat for the first bearing section of the coupling element and the second counter-bearing section forming a plain bearing seat for the second bearing section of the coupling element. The first and second counter-bearing sections of the lock housing can in particular be configured complementary to the first or second bearing section of the coupling element respectively. A counter-bearing can thus be dispensed with in the region of the shaft section, whereby the manufacture of the lock housing can be simplified.

In accordance with a preferred embodiment, the coupling element is formed from plastic. An embodiment composed of plastic in this respect reduces the weight of the coupling element even further, with the coupling element simultaneously being able to be manufactured simply and inexpensively, for example by an injection molding process. In addition, an electrical insulation between the latching member and the cylinder core is simultaneously provided by a coupling element formed from plastic. In combination with the lock body formed from plastic, a complete electrical insulation can be provided between the hoop and the latching member, on the one hand, and the cylinder core into which a key can be inserted, on the other hand.

To fix the hoop in the lock housing, the latching member preferably displaces and/or blocks at least one latch element in a latching position, said latch element coming into engagement with the hoop. For example, the latch element can be formed by two blocking balls which engage into spherical cut-outs of the hoop and thus prevent a pulling of the hoop out of the lock housing in the locked state.

In accordance with a further advantageous embodiment, a transition section in which the diameter of the coupling element continuously reduces is provided between the shaft section and the respective bearing section of the coupling element. The coupling element thus tapers in the transition region so far until the diameter of the shaft section is achieved. The transition section can, for example, have a contour of part circle shape or of part elliptical shape, with other curves, however, also being possible. Due to such a continuous diameter reduction, a higher stability of the coupling element toward torsion forces results so that an even smaller diameter of the shaft section can be realized with respect to a coupling element with a purely step-shaped transition between the respective bearing section and the shaft section with the same stability.

In accordance with a further advantageous embodiment, the cylinder core has an output section and the coupling element has a first coupling section at the first end, with the output section and the first coupling section being in form-fitted engagement with one another. The first coupling section and the output section in this respect serve to couple the cylinder core reliably and rotationally fixedly to the coupling element. To provide a rotationally fixed coupling, the first coupling section can, for example, be of part circle shape, in particular of semicircular shape, a straight web or a slot. In a complementary manner hereto, the output section can likewise be of part circle shape, in particular of semicircular shape or a slot or a web.

A simple, force-transmitting connection between the coupling element and the lock cylinder advantageously results by the structure of part-circle shape. In addition, the surface which contacts the first counter-bearing section is further reduced by the semicircular cut-out of the coupling section. Different materials for the coupling element and the locking element can also hereby be used.

In accordance with a further advantageous embodiment, the coupling element and the latching member are formed by separate parts. The coupling element and the latching member can thus be manufactured separately from one another. Coupling elements of different lengths can thereby be provided, for example, with the length of the coupling element being adapted to the length of the lock housing.

In accordance with a further advantageous embodiment, the coupling element has a second coupling section at the second end and the latching member has a drive section, with the second coupling section and the drive section being in force-transmitting engagement with one another. The second coupling section and the drive section can in this respect be formed in the same different manners as the output section and the first coupling section.

The second coupling section and the drive section are advantageously formed identically with the output section and the first coupling section, whereby a symmetrically shaped coupling element can result. Consequently, a correct orientation of the coupling element does not have to be considered in the assembly of the padlock.

In accordance with an alternative embodiment, the coupling element is an integral part of the latching member. The coupling element and the latching member can therefore be formed by a single component, whereby the assembly of the padlock can be simplified.

In accordance with a further advantageous embodiment, the lock body, as already mentioned, has at least one latch element (e.g. two blocking balls) which is movably supported in a locking region of the lock housing, with the latching member being adapted to urge the latch element in the latching position radially in the direction of the hoop with respect to an axis of rotation of the latching member to lock the hoop to the lock body. In this respect, the first bearing section and the second bearing section of the coupling element can be arranged in an extension region of the lock housing which is arranged axially between the locking region of the lock housing and the lock cylinder with respect to the axis of rotation of the latching member.

The coupling element is advantageously oriented along an axis of rotation of the cylinder core, with the coupling element being longer, viewed in the direction of the axis of rotation of the cylinder core, than the respective diameter of the bearing sections. The axis of rotation in this respect extends in a direction between the lock cylinder and the latching member. To achieve a length of the lock housing which is as large as possible, the coupling element can thus be configured as longer than the respective diameter of the bearing sections. The length of the coupling element can in particular be twice the size as a maximum diameter of the bearing sections. The possibility is provided by a variation of the length of the coupling element to vary and in particular to extend the dimensions of the padlock in a wide range without, for example, the latching member and the lock cylinder having to be modified. An increase in size of the lock housing is furthermore possible without the weight of the padlock increasing greatly.

In accordance with a further advantageous embodiment, the lock housing is at least twice as long in the direction of an axis of rotation of the coupling element than the maximum width of the lock housing in a direction perpendicular to the axis of rotation of the coupling element. The lock housing is thus at least twice as "high" as "wide", whereby sufficient space can be provided for a bilingual wording on the lock housing or for the attachment of a photo of the respective service engineer. A warning against the removal of the padlock can, for example, be applied in two languages to the lock housing, whereby the padlock can preferably be used in facilities that employ staff with different mother tongues.

The invention furthermore comprises a padlock for securing a switch of an industrial plant, having a lock body and a hoop which is displaceably held at the lock body, wherein the lock body has a lock housing composed of plastic, a lock cylinder having a rotatable cylinder core and a rotatable latching member, wherein the cylinder core and the latching member are rotationally fixedly coupled to one another by means of a coupling element and wherein the latching member is rotatable from a release position into a latching position to lock the hoop at the lock body. The alternative padlock in accordance with the invention is characterized in that the coupling element and the latching member are formed by separate parts, wherein the coupling element is supported at at least one first counter-bearing section and one second counter-bearing section of the lock housing and the lock housing comprises a throughgoing release section between the first and the second counter-bearing sections, in which release section the lock housing is set back from the counter-bearing sections and is hereby spaced apart from the coupling element.

The advantage is also achieved by this alternative padlock that the coupling element only contacts the counter-bearing sections of the lock housing with a small surface. Consequently, on a rotation of the coupling element, only small frictional forces are generated, whereby the padlock in accordance with the invention can be operated smoothly. The advantage of the small frictional forces is in particular also present when the coupling element is formed as a full cylinder since the contact surface of the full cylinder is greatly reduced by the release section of the lock housing.

The coupling element and the latching member can be manufactured from different materials due to the configuration of the coupling element and the latching member as separate parts. This makes it possible, for example, to manufacture the latching member from metal to achieve a stability which is as high as possible. The coupling element can be formed from plastic to save weight.

In accordance with an advantageous embodiment, the coupling element has a first end and a second end, wherein the coupling element is supported by the first end at the first counter-bearing section of the lock housing and by the second end at the second counter-bearing section of the lock housing.

In accordance with a further advantageous embodiment, the coupling element is only supported at the first counter-bearing section and the second counter-bearing section of the lock housing. The coupling element can thus be supported at the lock housing solely by the two counter-bearing sections, whereby friction can only occur at the counter-bearing sections.

BRIEF DESCRIPTION OF THE DRAWINGS

The invention will be explained in the following only by way of example with reference to the drawings. Elements which are the same or of the same kind are marked by the same reference numerals therein.

There are shown.

DETAILED DESCRIPTION OF THE PREFERRED EMBODIMENTS

Figure 1:
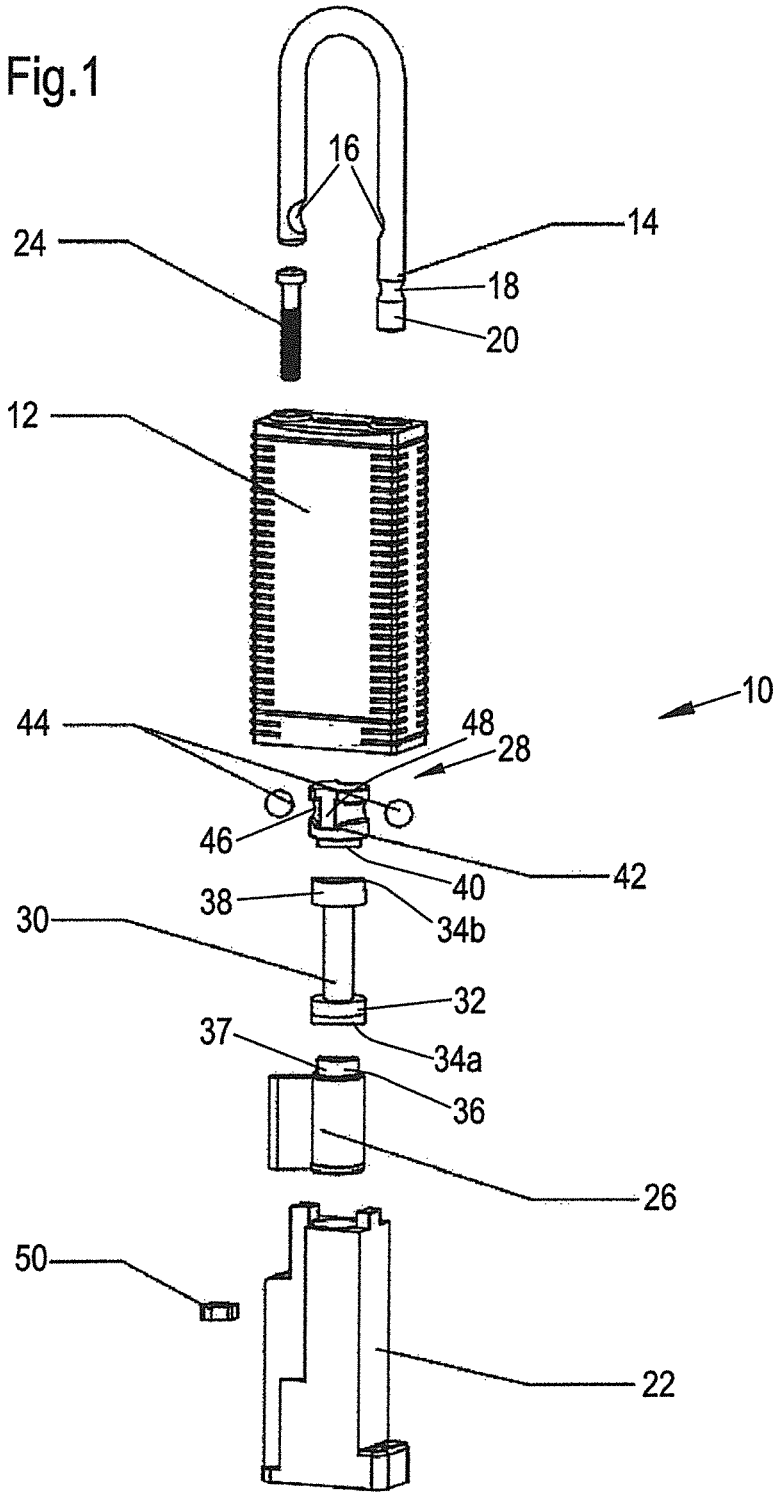
FIG. 1 a padlock in accordance with the invention in an exploded view.

The padlock 10 shown in FIG. 1 comprises a lock housing 12 and a hoop 14. The lock housing 12 is manufactured in one piece peripherally, whereby a welding of housing parts suffering from tolerances can be avoided. The hoop 14 has a U shape with one shorter limb and one longer limb. An inwardly directed locking recess 16 is formed at both limbs of the hoop 14. Furthermore, a ring groove 18 with an abutment head 20 adjacent to it is provided at the free end of the longer limb.

Figure 2:
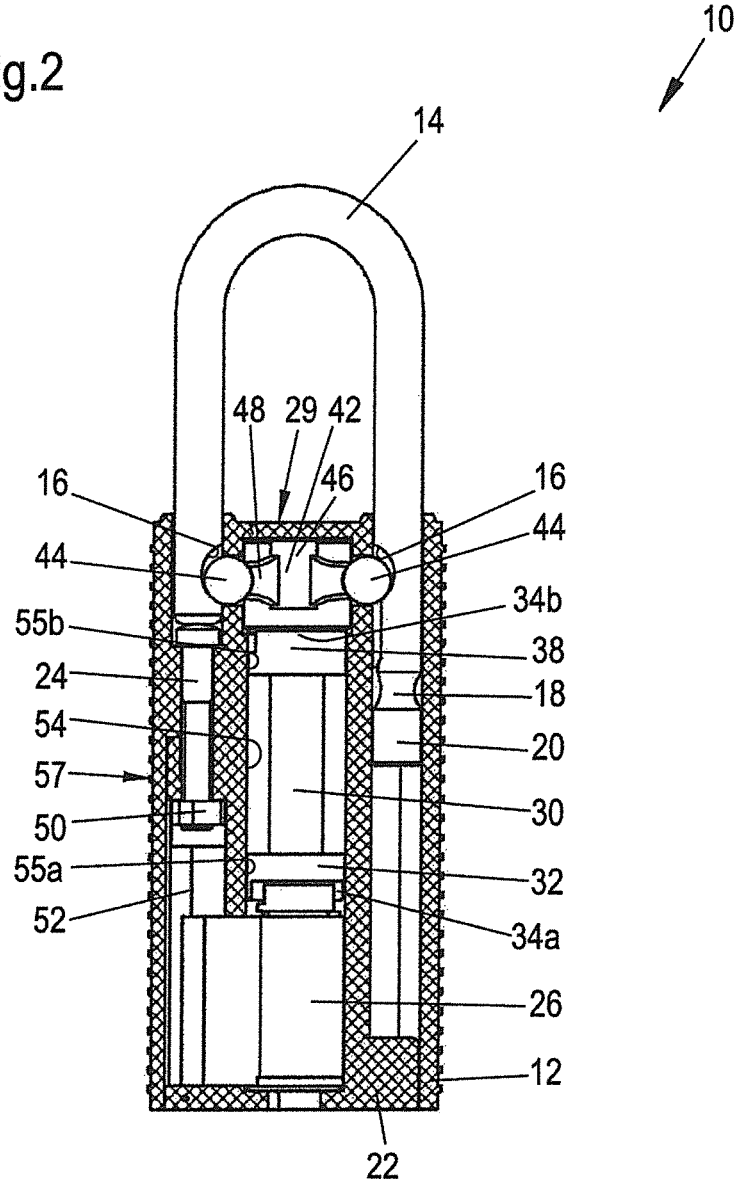
FIG. 2 a sectional view of the padlock of FIG. 1 in assembled form.

The lock housing 12 is configured for receiving a further housing part which is configured as an inner housing 22 in the embodiment shown. The lock housing 12 and the inner housing 22 are formed from a plastic. The inner housing 22 can be inserted into the lock housing 12 and can be fixed to the lock housing 12 by means of a securing screw 24, as will be explained in the following. The lock housing 12 and the inner housing 22 accommodate a lock cylinder 26 and a locking mechanism 28 which are arranged spaced apart from one another. The locking mechanism 28 is arranged in a locking region 29 which is formed by the upper region of the lock housing 12 (FIG. 2). The spacing between the lock cylinder 26 and the locking mechanism 28 is bridged by a coupling element 30. The coupling element 30 has at a first end a first bearing section 32 which is substantially cylindrical and comprises a semicircular first coupling section 34*a* (cf. FIG. 4*a*). The first coupling section 34*a* is in this respect rotationally fixedly coupled to a likewise semicircular output section 36 of a rotatable cylinder core 37 of the lock cylinder 26. The coupling element 30 is consequently also rotated by a rotation of the cylinder core 37.

At its second end, the coupling element 30 comprises a second bearing section 38 which has a semicircular second coupling section 34*b*. The second coupling section 34*b* of the coupling element 30 is rotationally fixedly coupled to a semicircular drive section 40 of a rotational bolt 42 of the locking mechanism 28. The locking mechanism 28 can thus be actuated by a rotation of the coupling element 30 which is caused by a rotational actuation of the cylinder core 37.

The named rotational bolt 42 serves as a latching member and cooperates with two blocking balls 44. The rotational bolt 42 has a substantially cylindrical shape, wherein two receiving recesses 46 are arranged at the jacket surface of the rotational bolt 42 and can receive the blocking balls 44 in part on an opening actuation of the lock cylinder 26 and on the rotation of the coupling element 30 and of the rotational bolt 42 associated therewith. At the periphery, in each case adjacent to the receiving recesses 46, the rotational bolt 42 comprises two locking sections 48 by which the blocking balls 44 can be held in a blocking engagement with the locking recesses 16 of the hoop 14.

By a corresponding actuation of the lock cylinder 26, the padlock 10 thus selectively allows the carrying out of the locking of the hoop 14 in the lock housing 12 or the release of the shorter limb of the hoop 14. The padlock 10 shown is in particular suitable for use as a lockout lock.

FIG. 2 shows a cross-sectional view of the padlock 10 of FIG. 1 in the assembled state and with a locked hoop 14. The inner housing 22 is pushed into the lock housing 12 and is fixed to the lock housing 12 by means of the securing screw 24 and by means of a nut 50 for the assembly of the padlock. The lock cylinder 26, the locking mechanism 28 and the coupling element 30 are thereby captured in the lock housing 12. The securing screw 24 is inserted into a hoop receiving passage 52 of the lock housing 12 which is closed by the hoop 14 when the hoop 14 is locked in the lock body 12—as shown in FIG. 2. In the locked state, the securing screw 24 can thus not be reached, whereby in particular the inner housing 22 and thus the lock cylinder 26 cannot be removed from the lock housing 12.

FIG. 2 shows a state of the padlock 10 in which the hoop 14 is locked and is thus secured against removal from the lock housing 12. The locking sections 48 of the rotational bolt 42 hold the blocking balls 44 in a blocking engagement with the locking recesses 16 of the hoop 14 for this purpose. To unlock the padlock 10, an opening rotational actuation of the lock cylinder 26 by means of an associated key is required. The cylinder core 37, the coupling element 30 rotationally coupled to the cylinder core 37 and the rotational bolt 42 are hereby rotated about 90° so that a respective receiving recess 46 of the rotational bolt 42 is rotated into the region of the blocking balls 44. The blocking balls 44 can thus move back out of the locking recesses 16 of the hoop 14. The hoop 14 can now be pulled out of the lock body 12 axially until the abutment head 20 of the longer hoop limb abuts the respective blocking ball 44. The shorter limb of the hoop 14 now already projects out of the lock housing 12. The hoop 14 can now be rotated about the longitudinal axis of the longer hoop limb. Another locking of the hoop 14 in the lock housing 12 takes place in the reverse order.

On a rotational actuation of the lock cylinder 26 by 90°, the rotational actuation is communicated from the lock cylinder 26 to the rotational bolt 42 by the coupling element 30. On the rotational movement, the first bearing section 32 and the second bearing section 38 slide along an inner cylinder surface 54 of the inner housing 22 which has a first counter-bearing section 55*a* and a second counter-bearing section 55*b*. The counter-bearing sections 55*a*, 55*b* form cylindrical counter-support surfaces which define a plain bearing seat for the coupling element 30 and provide that the coupling element 30 can only carry out a rotational movement, but otherwise remains fixedly positioned and is in particular arranged rotationally fixedly with the cylinder core 37 and the rotational bolt 42. The counter-bearing sections 55*a*, 55*b* are configured in one piece peripherally. On the rotational actuation of the coupling element 30, frictional forces thus only arise at the first and second bearing sections 32, 38 of the coupling element 30 due to the sliding of the bearing sections 32, 38 in the counter-bearing sections 55*a*, 55*b*. A frictional force can additionally be reduced by the selection of a suitable plastic material for manufacturing the coupling element 30.

The coupling element 30 communicates a rotation of the cylinder core 37 to the rotational bolt 43 over a length of an axial extension region 57. The longer the extension region 57 is, the longer the lock housing 12 also is.

Figure 3:
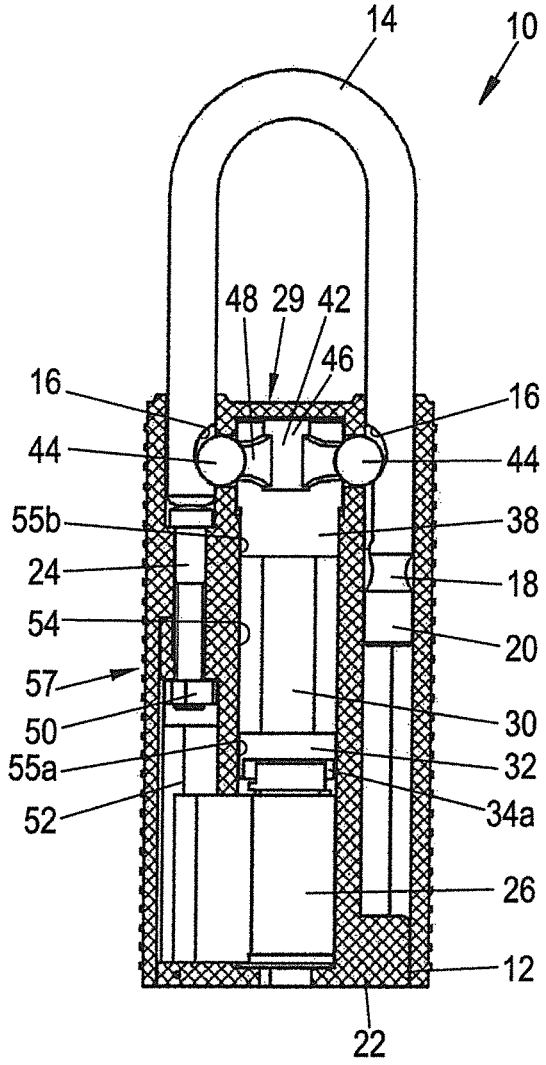
FIG. 3 a sectional view of a second embodiment of a padlock in accordance with the invention in assembled form.

The second embodiment of a padlock 10 shown in FIG. 3 is substantially identical with the padlock 10 of FIGS. 1 and 2, but the rotational bolt 42 and the coupling element 30 are configured as a single component, that is in one piece. The second coupling section 34*b* and the drive section 40 are thus omitted in the embodiment shown in FIG. 3.

Figure 4A:
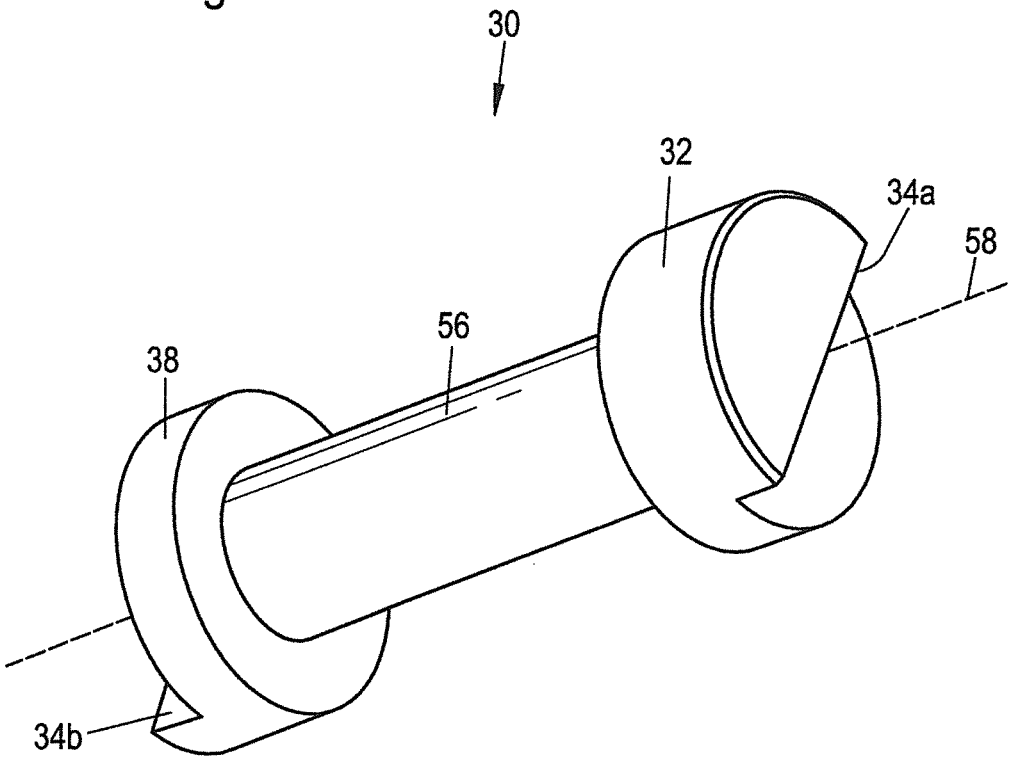
FIG. 4*a* a perspective representation of a first embodiment of a coupling element.

FIG. 4*a* shows a perspective view of a possible embodiment of a coupling element 30 which has a first bearing section 32 as well as a second bearing section 38. The first and second bearing sections 32, 38 are connected to one another by a shaft section 56. The shaft section 56 as well as the first and second bearing sections 32, 38 are arranged substantially rotationally symmetrically along an axis 58. The shaft section 56 has a circular cross-section and additionally has a smaller diameter than the bearing sections 32,38 so that the shaft section 56 is directly adjacent to the facing end face of the respective bearing section 32, 38 and is set back radially with respect to the respective bearing section 32, 38.

To establish a rotationally fixed coupling with the cylinder core 37 of the lock cylinder 26 and with the rotational bolt 42, the first and second bearing sections 32, 38 each have a semicircular coupling section 34*a*, 34*b* by which it is made possible for the coupling element 30 to transmit a rotational movement of the cylinder core 37 to the rotational bolt 42.

Figure 4B:
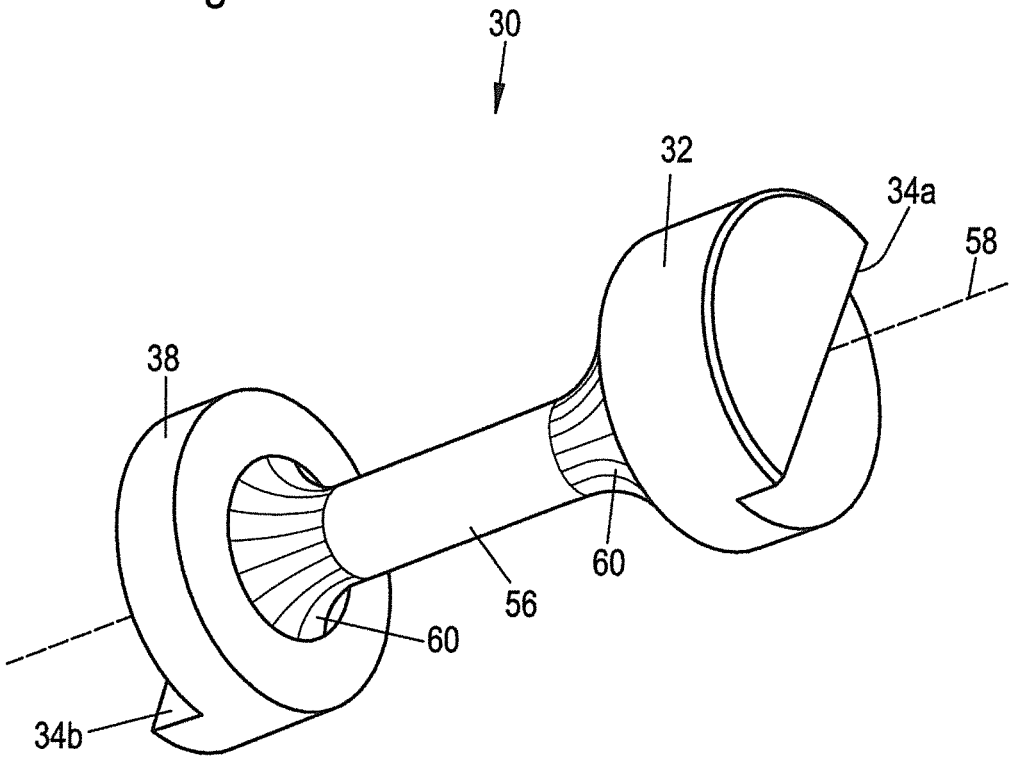
FIG. 4*b* a perspective representation of a second embodiment of a coupling element.

A second embodiment of a coupling element 30 is shown in FIG. 4*b*. The coupling element 30 of FIG. 4*b* is substantially identical with the coupling element 30 of FIG. 4*a*, but differs in that the shaft section 56 has a smaller diameter at its center. Unlike the purely step-shaped transition in accordance with FIG. 4*a*, the shaft section 56 merges in each case with a continuous transition section 60 into the bearing sections 32, 38. The transition section 60, for example, has a contour of part circle shape or of quarter-elliptical shape, whereby the diameter of the coupling element 30 becomes continuously larger on the transition into the bearing sections 32, 38. At the ends, however, the respective transition section 60 is radially set back in a similar manner as in FIG. 4*a* with respect to the associated bearing section 32, 38, i.e. the respective transition section 60 is adjacent to the facing end face of the respective bearing section 32, 38 and does not extend approximately radially up to the peripheral surface of the respective bearing section 32, 38.

Figure 4C:
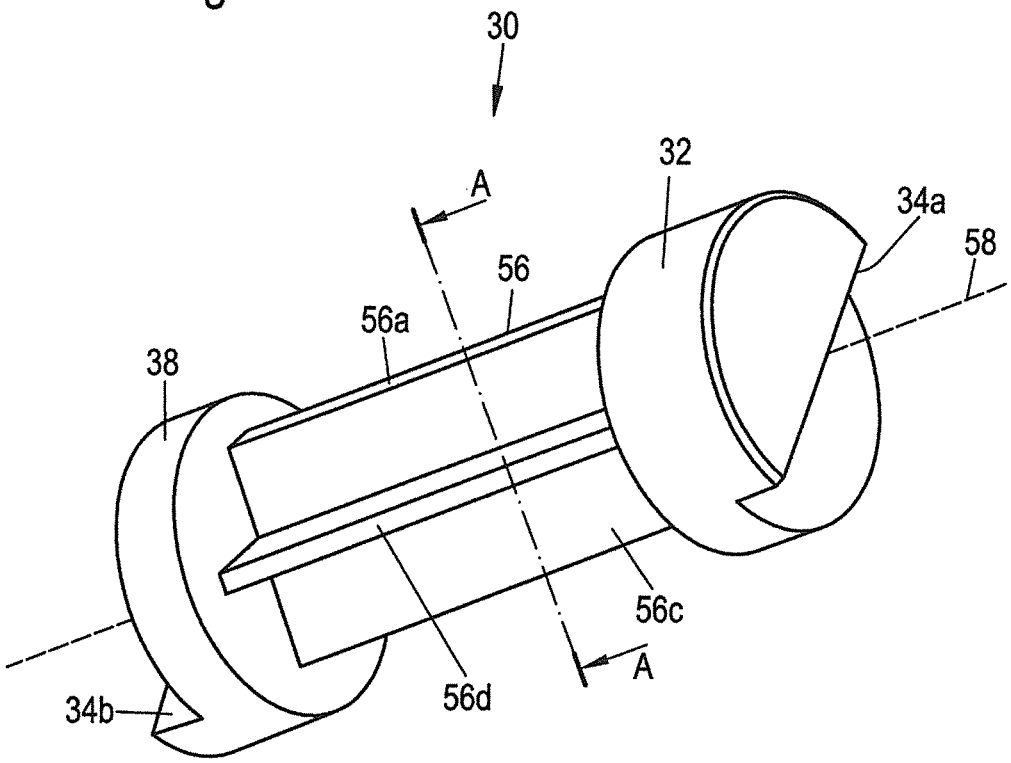
FIG. 4*c* a perspective representation of a third embodiment of a coupling element.

FIG. 4*c* shows a third embodiment of a coupling element 30. Unlike the coupling element 30 of FIG. 4*b*, the coupling element 30 of FIG. 4*c* comprises a shaft section 56 whose cross-section is "+" shaped, i.e. is configured as a crossed bar. The shaft section 56 comprises four limbs 56*a*, 56*b*, 56*c*, 56*d* (also called wings) which extend away from a central point and which each include an angle of 90° with respect to the adjacent limbs 56*a*, 56*b*, 56*c*, 56*d*. The limbs 55*a*, 56*b*, 56*c*, 56*d* extend between the bearing sections 32, 38. The cross-section of the shaft section 56 along a plane A-A in accordance with FIG. 4*c* is shown in the sectional view of FIG. 4*d*, with the cross-section of the shaft section 56 not varying between the bearing sections 32, 38 in the embodiment of FIG. 4*c*.

Differing from the representation in accordance with FIG. 4*c*, the shaft section 56 can also have a different number of limbs 56*a*, 56*b*, 56*c*, 56*d*, for example three, five, six or eight limbs, so that in the event of a regular angular pitch two adjacent limbs include an angle of 120°, 72°, 60° or 45°. The cross-section of the shaft section 56 in these embodiments can thus generally be called star-shaped with a corresponding number of limbs, i.e. as a star with three or more points. Furthermore, the two side surfaces of a respective limb 56*a*, 56*b*, 56*c*, 56*d* do not necessarily have to extend in a plano-parallel fashion, differing from the representation in accordance with FIG. 4*c*, but can rather include an acute angle with respect to one another.

Figure 4D:
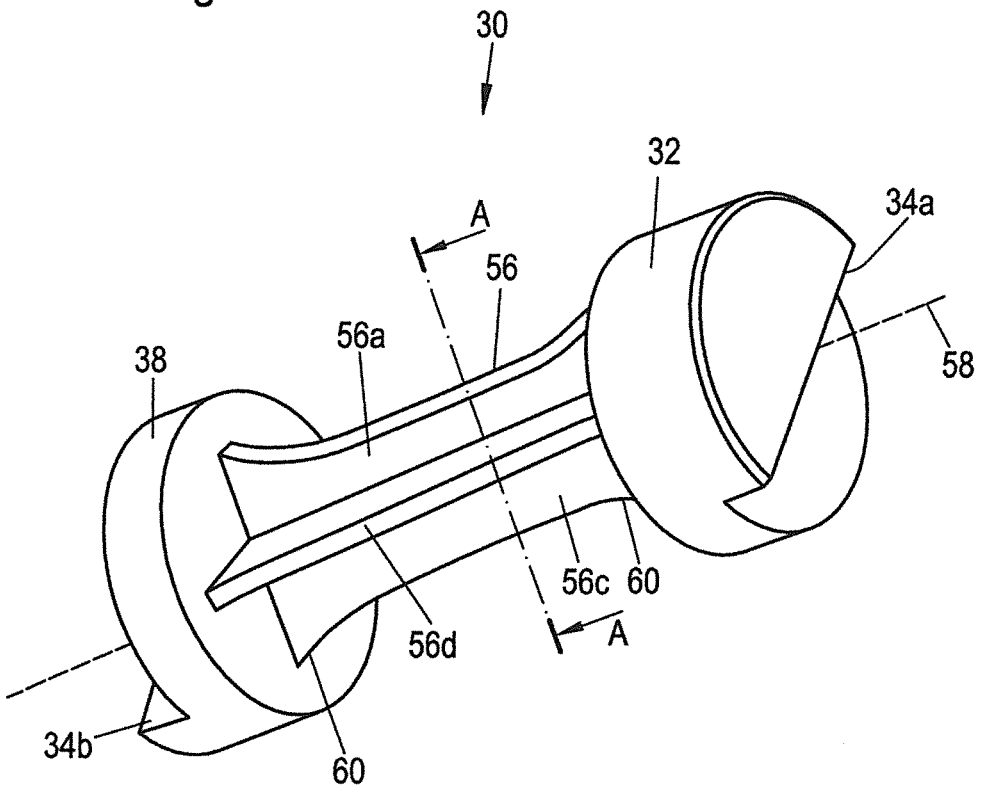
FIG. 4*d* a perspective representation of a fourth embodiment of a coupling element.
Figure 4D:
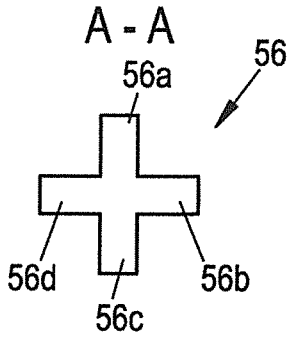

A fourth embodiment of a coupling element 30 is shown in FIG. 4*d*. As in the embodiment of FIG. 4*c*, the coupling element 30 comprises a shaft section 56 which is formed as a cross-bar and which now, however, comprises two transition sections 60 in accordance with the embodiment of FIG. 4*b* which, for example, have a contour of part circular shape or of quarter-elliptical shape. The minimal diameter of the coupling element 30 can hereby be configured even smaller, with the diameter of the shaft section 56 becoming continuously larger on the transition into the bearing sections 32, 38 due to the transition sections 60. As in FIG. 4*c*, the shaft section 56 can also have a different number of limbs 56*a*, 56*b*, 56*c*, 56*d*.

Figure 5:
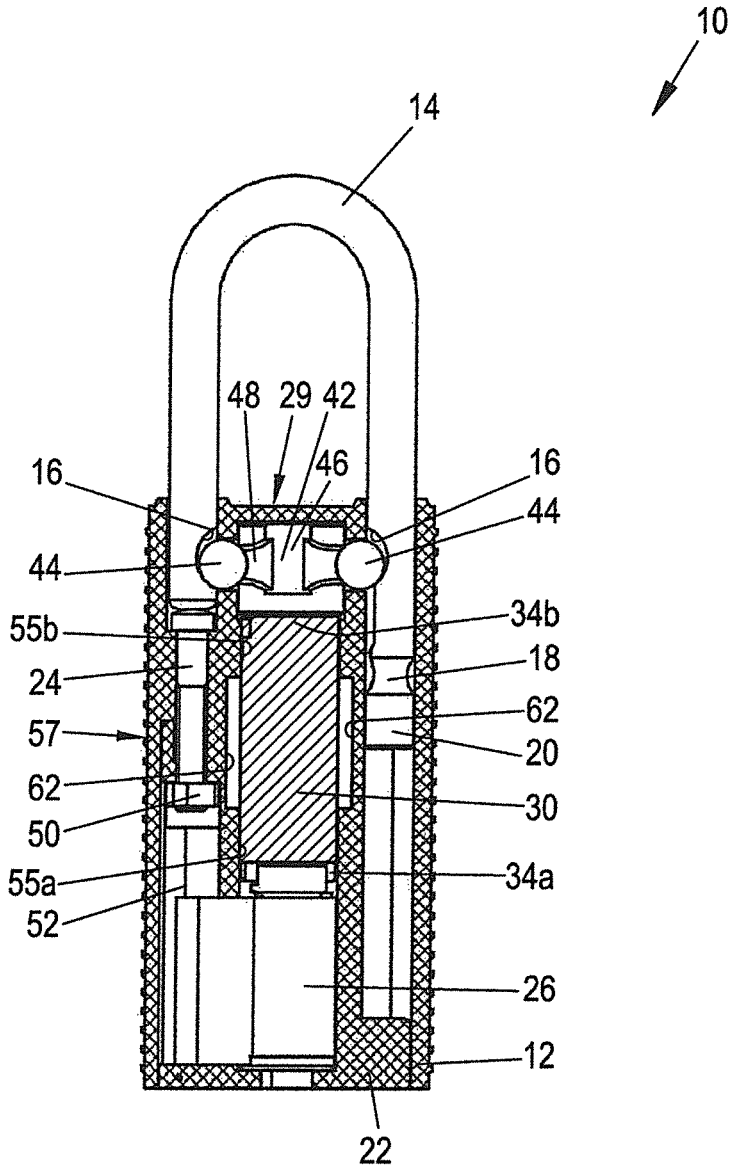
FIG. 5 a sectional view of a third embodiment of a padlock in accordance with the invention in assembled form.

A third embodiment of a padlock 10 is shown in FIG. 5. This embodiment is substantially identical with the first embodiment of FIGS. 1 and 2. However, the coupling element 30 is not configured in the form of a barbell, but as a cylinder. To avoid a large-area friction of the cylindrical coupling element 30 at inner walls of the lock housing 12, a release section 62 is arranged between the counter-bearing sections 55*a*, 55*b*, extends in the peripheral direction of the coupling element 30 and extends in a throughgoing manner from the first counter-bearing section 55*a* up to the second counter-bearing section 55*b*. The release section 62 is radially set back with respect to the counter-bearing sections 55*a*, 55*b*. The release section 62 is configured such that the coupling element 30 is not in contact with the lock housing 12 in the region of the release section 62.

The invention claimed is:

1. A padlock for securing a switch of an industrial plant, comprising a lock body and a hoop which is displaceably held at the lock body, wherein the lock body has a lock housing composed of plastic, a lock cylinder having a rotatable cylinder core, and a rotatable latching member, wherein the cylinder core and the latching member are rotationally fixedly coupled to one another by means of a coupling element, and wherein the latching member is rotatable from a release position into a latching position to lock the hoop at the lock body, wherein the coupling element has at least one first bearing section, one second bearing section, and a shaft section between the latching member and the lock cylinder, said shaft section being arranged between the first bearing section and the second bearing section and said shaft section connecting the first bearing section to the second bearing section and the shaft section having a smaller diameter than either of the first or the second bearing section, wherein the first bearing section is arranged at a first end of the coupling element and the second bearing section is arranged at a second end of the coupling element, wherein the first and second bearing sections of the coupling element each have cylindrical support surfaces at their periphery which remain in contact with a first and a second counter-bearing section, respectively, in said lock housing as said latch member rotates between said release position and said latching position.

2. The padlock in accordance with claim 1, wherein the bearing sections of the coupling element have cylindrical support surfaces at their periphery.

3. The padlock in accordance with claim 1, wherein the first counter-bearing section and the second counter-bearing section of the lock housing are formed in one piece peripherally.

4. The padlock in accordance with claim 1, wherein the coupling element is formed from plastic.

5. The padlock in accordance with claim 1, wherein the shaft section of the coupling element has a star-shaped cross-section having at least three limbs.

6. The padlock in accordance with claim 1, further comprising a transition section between the shaft section and the respective bearing section of the coupling element, wherein a diameter of the coupling element continuously reduces in the transition section.

7. The padlock in accordance with claim 1, wherein the cylinder core has an output section and the coupling element has a first coupling section at a first end, wherein the output section and the first coupling section are in form-fitted engagement with one another.

8. The padlock in accordance with claim 1, wherein the coupling element and the latching member are formed by separate parts.

9. The padlock in accordance with claim 1, wherein the lock body further comprises at least one latch element which is movably supported in a locking region of the lock housing, wherein the latching member is adapted to urge the at least one latch element radially in the direction of the hoop with respect to an axis of rotation of the latching member in the latching position to lock the hoop at the lock body; and wherein the first bearing section and the second bearing section of the coupling element are arranged in an extension region of the lock housing, said extension region being arranged axially between the locking region of the lock housing and the lock cylinder with respect to the axis of rotation of the latching member.

10. A padlock for securing a switch of an industrial plant, comprising a lock body and a hoop which is displaceably held at the lock body, wherein the lock body has a lock housing composed of plastic, a lock cylinder having a rotatable cylinder core, and a rotatable latching member, wherein the cylinder core and the latching member are rotationally fixedly coupled to one another by means of a coupling element, and wherein the latching member is rotatable from a release position into a latching position to lock the hoop at the lock body, wherein the coupling element and the latching member are formed by separate parts, wherein the coupling element is supported at at least one first counter-bearing section and one second counter-bearing section of the lock housing and the lock housing comprises a throughgoing release section between the first and the second counter-bearing sections, the lock housing being set back from the counter-bearing sections in the throughgoing release section and hereby being spaced apart from the coupling element, wherein the coupling element has a first end and a second end, wherein the coupling element is supported by and remains in contact at the first end with the first counter-bearing section of the lock housing and is supported by and remains in contact at the second end with the second counter-bearing section of the lock housing as said latching member moves between said release and said latching positions.

11. The padlock in accordance with claim 10, wherein the coupling element is only supported in a radial direction at the first counter-bearing section and at the second counter-bearing section of the lock housing.

12. A padlock for securing a switch of an industrial plant, comprising a lock body and a hoop which is displaceably held at the lock body, wherein the lock body has a lock housing composed of plastic, a lock cylinder having a rotatable cylinder core, and a rotatable latching member, wherein the cylinder core and the latching member are rotationally fixedly coupled to one another by means of a coupling element, and wherein the latching member is rotatable from a release position into a latching position to lock the hoop at the lock body, wherein the coupling element has at least one first bearing section, one second bearing section, and a shaft section between the latching member and the lock cylinder, said shaft section being arranged between the first bearing section and the second bearing section and said shaft section connecting the first bearing section to the second bearing section and the shaft section having a smaller diameter than either of the first or the second bearing section, wherein the coupling element and the latching member are formed by separate parts, wherein the lock body further comprises at least one latch element which is movably supported in a locking region of the lock housing, wherein the latching member is adapted to urge the at least one latch element radially in the direction of the hoop with respect to an axis of rotation of the latching member in the latching position to lock the hoop at the lock body, wherein the first bearing section and the second bearing section of the coupling element are arranged in an extension region of the lock housing, said extension region being arranged axially between the locking region of the lock housing and the lock cylinder with respect to the axis of rotation of the latching member, and wherein said first and second bearing sections contact a first and second counter-bearing section, respectively, in the body as said latch member rotates between said latching and said release positions.

13. The padlock in accordance with claim 12, wherein the coupling element has a second coupling section at a second end and the latching member has a drive section, wherein the second coupling section and the drive section are in form-fitted engagement with one another.

14. The padlock in accordance with claim 12, wherein the coupling element is an integral part of the latching member.

15. The padlock in accordance with claim 12, wherein the coupling element is oriented along an axis of rotation of the cylinder core, with the coupling element being longer, viewed in the direction of the axis of rotation of the cylinder core, than a respective diameter of the first and the second bearing sections.

16. The padlock in accordance with claim 12, wherein the lock housing is at least twice as long in the direction of an axis of rotation of the coupling element as the maximum width of the lock housing in a direction perpendicular to the axis of rotation of the coupling element.

* * * * *